US011648584B2

(12) United States Patent
Guzman et al.

(10) Patent No.: US 11,648,584 B2
(45) Date of Patent: May 16, 2023

(54) PRODUCTION METHOD AND APPARATUS FOR APPLYING FAUX WOOD GRAIN FINISH ON MATERIAL

(71) Applicant: HARDIE BOYS, INC., Pompano Beach, FL (US)

(72) Inventors: David Guzman, Pompano Beach, FL (US); Lionel Guzman, Pompano Beach, FL (US)

(73) Assignee: Hardie Boys, Inc., Pompano Beach, FL (US)

( * ) Notice: Subject to any disclaimer, the term of this patent is extended or adjusted under 35 U.S.C. 154(b) by 0 days.

(21) Appl. No.: 17/814,265

(22) Filed: Jul. 22, 2022

(65) Prior Publication Data

US 2023/0026075 A1 Jan. 26, 2023

Related U.S. Application Data

(60) Provisional application No. 63/224,673, filed on Jul. 22, 2021.

(51) Int. Cl.

| | |
|---|---|
| ***B05D 3/06*** | (2006.01) |
| ***B05D 7/00*** | (2006.01) |
| ***B05D 3/04*** | (2006.01) |

(52) U.S. Cl.

CPC ..... *B05D 7/536* (2013.01); *B05D 3/0426* (2013.01); *B05D 3/06* (2013.01); *B05D 2201/02* (2013.01)

(58) Field of Classification Search

CPC ..... B05D 7/536; B05D 3/0426; B05D 3/06; B05D 2201/02

See application file for complete search history.

(56) References Cited

U.S. PATENT DOCUMENTS 5,084,303 A * 1/1992 Avera ..... B05D 5/061 427/265

FOREIGN PATENT DOCUMENTS

WO WO-2006010141 A2 * 1/2006 ..... B05D 1/30

* cited by examiner

*Primary Examiner* — Hai Y Zhang

(74) *Attorney, Agent, or Firm* — McHale & Slavin, P.A.

(57) ABSTRACT

A method and apparatus for applying a faux wood grain finish to plastic architectural plastic boards. The method employs a climate-controlled area for denibbing of boards to prepare a surface and a sprayer to achieve a desired depth of color. A wiper spreads the sprayed on material to form a faux grain finish which may include faux wood knots. The boards are directed through a combination infrared and convection oven having independent curing zones providing specific drying profiles. Once cured, the boards are cooled with forced air cool down fans and transferred into a climate-controlled area for applying a topcoat. The topcoat board is passed through an oven set to a defined temperature for curing and cooled down with forced air cool down fans before packaging and shipping.

9 Claims, 3 Drawing Sheets

PRODUCTION METHOD AND APPARATUS FOR APPLYING FAUX WOOD GRAIN FINISH ON MATERIAL

CROSS REFERENCE TO RELATED APPLICATION

In accordance with 37 C.F.R. 1.76, a claim of priority is included in an Application Data Sheet filed concurrently herewith. Accordingly, the present invention claims priority to U.S. Provisional Patent Application No. 63/224,673 entitled "PRODUCTION METHOD AND APPARATUS FOR APPLYING FAUX WOOD GRAIN FINISH ON MATERIAL", filed Jul. 22, 2021. The contents of which are incorporated herein by reference.

FIELD OF THE INVENTION

The invention is directed to the field of architecture; and in particular, to a method and apparatus for applying faux wood grain finish on material, forming architectural trim components.

BACKGROUND OF THE INVENTION

Architectural trim components are traditionally constructed from wood. Unfortunately, wood is susceptible to decay, most commonly referred to as dry rot. Dry rot is caused by certain fungi, which grows when moisture is present. As the fungi grow, they digest the wood and cause the wood to shrink, evidenced by unsightly brown discoloration and cracking. Some fungi secrete an enzyme that breaks down cellulose in wood, which can also lead to discoloration and cracking, known as soft rot.

Plastics, fiber cement board, and the like have been recognized as a substitute for wood based architectural trim structures. Cellular polyvinylchloride has excellent weather resistant qualities, can be treated to resist ultraviolet radiation, and has a surface porosity that accepts painting. However, simply painting PVC plastic does not automatically result in an aesthetically pleasing appearance. Hand painting techniques can be taught but are slow and labor intensive. Hand painting requires an artistic skill level if the plastic is to take on a realistic wood appearance. Further, hand painting exposes the worker to residual fumes that may lead to health issues unless the worker is properly protected.

What is lacking in the industry is an automated method and apparatus for applying faux wood grain finish on PVC and the like material used to form architectural trim components.

SUMMARY OF THE INVENTION

A method and apparatus for applying a faux wood grain finish to PVC or cement fiber boards. The method comprises a step of denibbing and cleaning of boards in a climate-controlled area, wherein a sprayed-on coating is employed to achieve a desired depth of color on the surface of the boards. The method includes the use of a wiper to form a faux wood grain finish, with an option of detailing the grain finish to include simulated wood knots. The treated material is directed through a combination infrared and convection oven having independently controlled curing zones, each providing a specific drying profile followed by forced air cool down fans. The treated boards are then transferred into a climate-controlled area for applying a topcoat; the topcoat is cured in an oven and the finished boards are cooled down with forced air cool down fans before packaging and shipping.

An objective of the invention is to provide a method and apparatus that automates the application of a faux wood grain finish on PVC or cement fiber boards.

Another objective of the invention is to provide a method and apparatus for applying faux wood grain finish that reduces human exposure to the finishing process.

Still another objective of the invention is to teach an automated painting process that provides repeatable results currently obtained only with application by a skilled worker.

Yet another objective of the invention is to teach an automated finishing process that can treat PVC boards used for architectural trim at a controlled rate, including curing and cooling steps to expedite preparation of faux wood grain finished boards.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

BRIEF DESCRIPTION OF THE DRAWINGS

Figure 1:
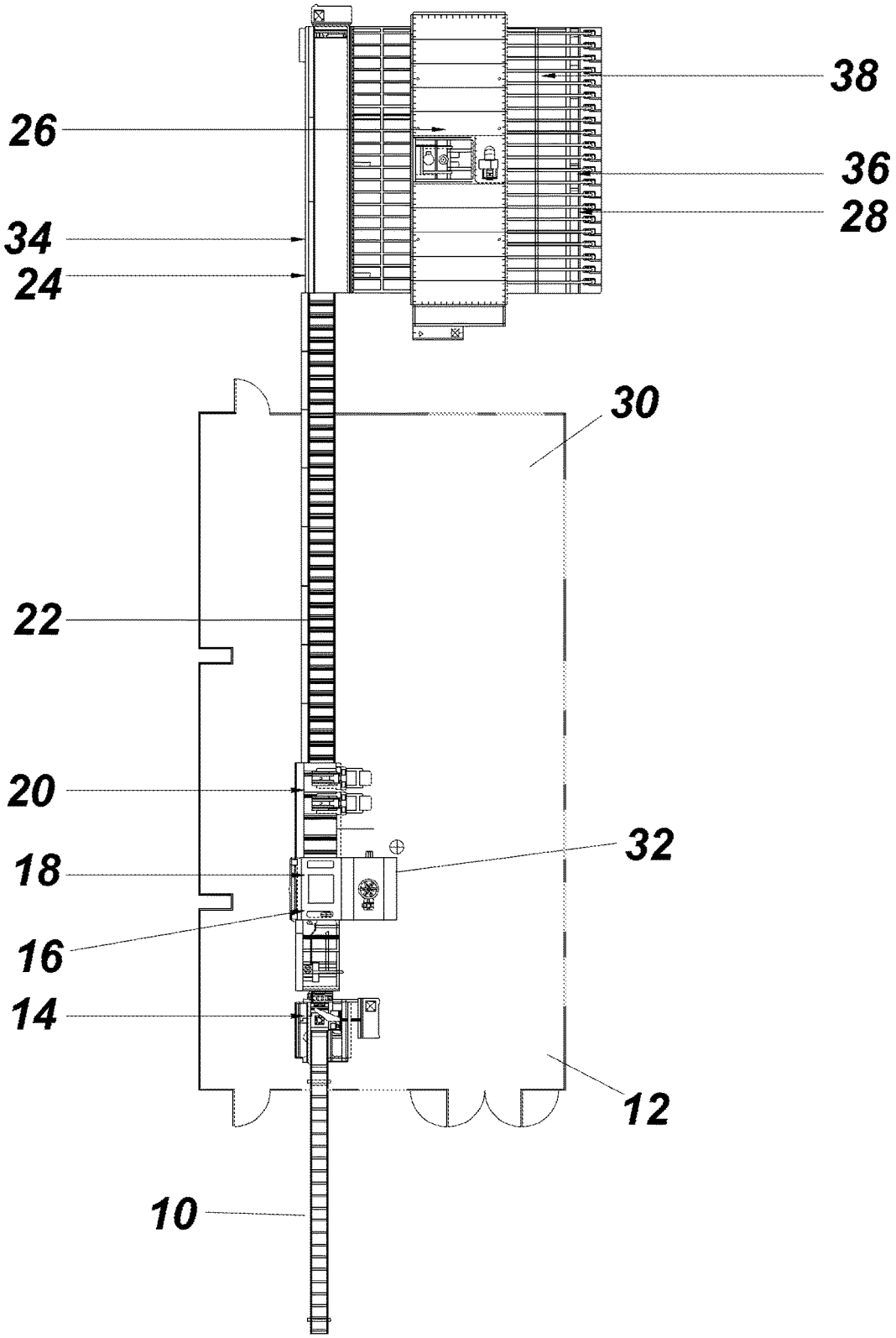
FIG. 1 is a pictorial view of the apparatus of the instant invention for applying faux wood grain finish.
Figure 2A:
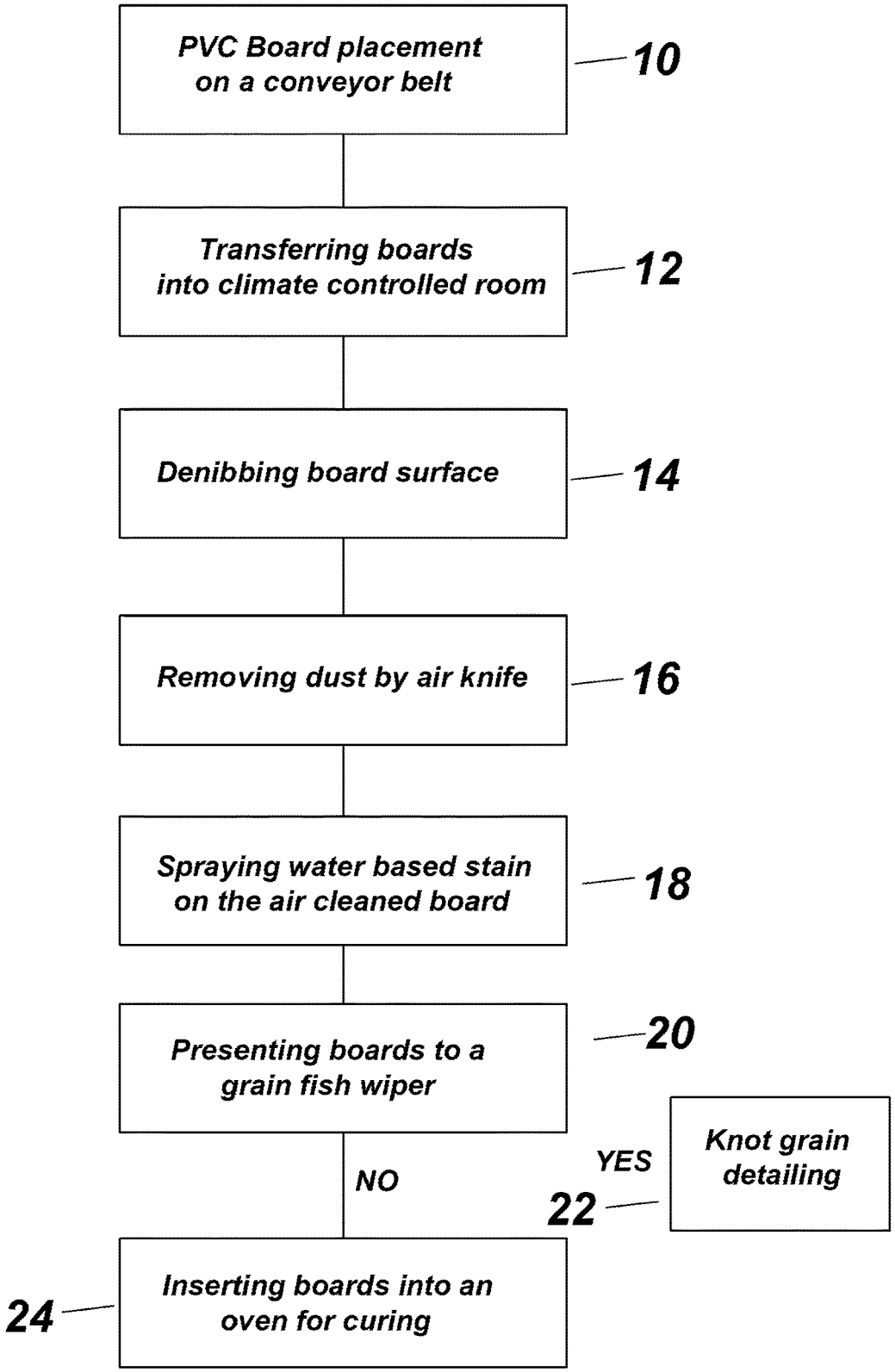
FIG. 2A is a flow diagram of the method for applying faux wood grain finish.
Figure 2B:
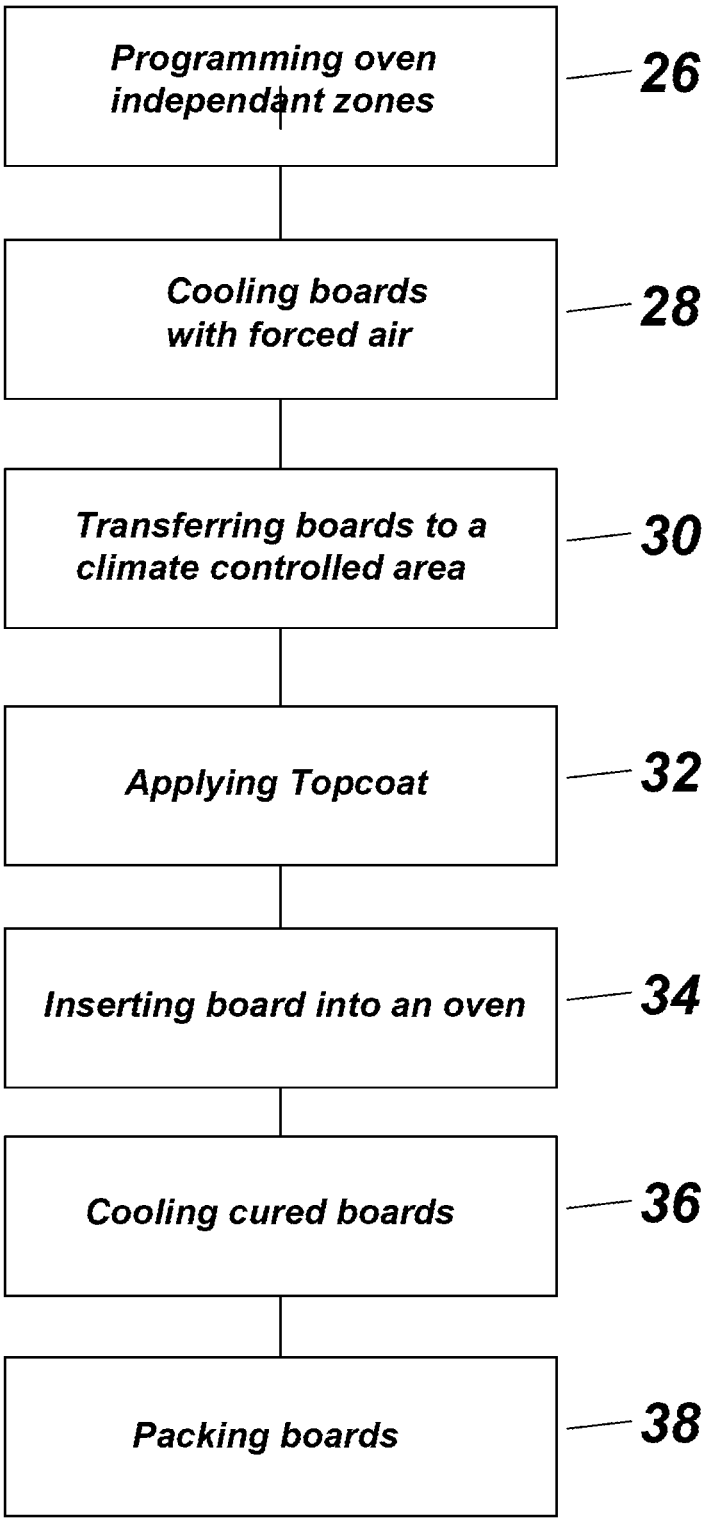
FIG. 2B is the continuation of the flow diagram from FIG. 2A.

The production method and apparatus for applying faux wood grain finish on cellular polyvinylchloride, cement fiber, or the like architectural trim materials. The method provides an enhanced production rate and a repeatable design that is not possible when performed by hand. Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Disclosed is a method and apparatus for applying a faux wood grain finish to cellular polyvinylchloride (PVC) boards or cement fiber boards. Placing (10) unfinished boards ranging in size from 30" to 240" long and from 1" to 12" wide on a conveyor belt. Transferring (12) the unfinished boards into a climate-controlled area. The climate-controlled area is for temperature and humidity control. Too high of temperatures will cause the staining process to cure prematurely; too low of temperature can result in dimples, commonly referred to as orange peel. The preferred temperature is 70° F., with a working range of 50° F. to 90° F. and a humidity range between 50-70%. Denibbing (14) the unfinished boards. The denibber 14 removes surface contaminants and lightly scuffs the surface of the unfinished boards. During the denibbing step, the unfinished boards adjust to the climate controlled area temperature by conduction and convection. In one embodiment, the denibber contains at least two heads capable of surface preparation with about 220 grit abrasives at rates up to 100 fpm (feet per minute). Removing (16) of dust generated by the denibber step (14) by use of an air knife. The air knife is formed from a pressurized air plenum creating an air velocity designed to shear away moisture or particulates without mechanical contact.

Spraying (18) a water-based stain on the surface of the boards cleaned with the air knife. The stain is applied by at least one sprayer to achieve a desired depth of color on the surface of the boards to obtain a faux finish simulating a wood color. In a preferred embodiment, the use of three sprayers is employed, a top spray gun and two side spray guns to coat the three main profiles of the board. The step of applying the faux wood grain finish includes the application of color to different boards, allowing a color tone to vary based on surface color. One manufacture of a spray-on material suitable for the PVC application is the GrainEx coating which is capable of being applied with high volume, low pressure spray equipment. In one embodiment, the step of spraying is performed by a wide canopy moulding finishing machine capable of spraying material at a rate up to 100 fpm; the spray equipment having an adjustment section which is adjustable to the depth of color of the graining portion of this process. The finishing machine has an 18" diameter, 3,000 CFM axial exhaust fan. Presenting (20) the boards sprayed with a faux finish beneath a wiper constructed and arranged to form a faux grain finish resembling wood grain; the wiper having a spindle powered by a 1 HP motor operating up to 600 rpm. The wood grain can be made repetitive, wherein each board has the same wood grain pattern; or the wiper can be offset using a PLC, wherein each board has a unique wood grain pattern. In the preferred embodiment, the wipers consist of two single head heavy duty GrainEx wipers for spreading of the sprayed on material; the wipers being constructed and arranged to create a wood grain look in the spray applied material. Predicable capacity of the spray-on material is estimated using a line speed of 1.5 fpm:

| Part Size | Dry Time | Board Footage/ Shift | Lineal Footage/ Shift |
|---|---|---|---|
| 4" × 20' | 60 Seconds | 11,333 | 34,000 |
| 8" × 20' | 60 Seconds | 22,666 | 34,000 |
| 12" × 20' | 60 Seconds | 34,000 | 34,000 |

Detailing (22) of the wood grain can be performed to include one or more knots shaped to resemble knots found in real wood. The step of detailing is optional and can be hand created or computer generated using a wood knot wiper. Inserting (24) the finished board from said climate-controlled area into a combination infrared and a convection oven having independently controlled curing zones. The oven contains IR emitters totaling 90 kw/480V/112.5 amps and operates between 100° F.-180° F. using multiple independent zones. The independent zones allow a near continuous flow of boards being cured in the oven with approximately one minute oven residence time at a speed of 7.5 fpm. Programming (26) independently controlled curing zones provides a specific drying profile for each finished part. For instance, one zone can be used to dry a set of boards while another set of boards is being stained. A conveyor carries the stained boards into an oven entrance, and additional boards can be set on the conveyor right behind the previous boards. In a preferred embodiment, the coating is allowed to flow out for approximately 30 seconds before entering the oven. As the boards continue through the oven, they pass through independently controlled curing zones; the oven having a convection airflow. Independent zone IR emitters are set to provide a specific drying profile for the grain flow applied. The profiles would each receive one minute oven residence time at a line speed of about 7.5 fpm. Cooling (28) the oven cured finished boards with forced air cool down fans or a forced air conditioner cool down. The cool down is helpful in lowering the coating and substrate temperatures.

Transferring (30) the cooled finished boards into a climate-controlled area. For ease of illustration, FIG. 1 depicts the use of the same climate control area, sprayer, and oven as mentioned above. While the same area can be used for the topcoat process, the dual use has a disadvantage of slowing the process due to equipment using multiple steps but has a benefit of cost reduction. For lower production rates, reuse of the above devices is acceptable. The apparatus being modular allows an additional climate controlled area, sprayer, and oven to be added as production increases. Thus, in a preferred embodiment, the climate-controlled area is an additional area, allowing the production to continue at an expedited rate. Applying (32) topcoat to the cooled finished boards is performed in the climate controlled area (30). The topcoat can be clear or tinted and is used to provide long term protection of the stained board. Inserting (34) the topcoat finished board into a combination infrared and convection oven for curing of the topcoat with approximately a five minute oven residence time at speed of 1.5 fpm. Cooling (36) the oven cured topcoat finished boards with forced air cool down fans. Predicable capacity of the spray-on top-coat material is estimated at:

| Part Size | Dry Time | Board Footage/ Shift | Lineal Footage/ Shift |
|---|---|---|---|
| 4" × 20' | 300 Seconds | 10,000 | 30,000 |
| 8" × 20' | 300 Seconds | 10,986 | 16,480 |
| 12" × 20' | 300 Seconds | 11,580 | 11,590 |

Once the boards are cooled, packaging (38) of the boards allows for ease of shipping for subsequent installation. The repeatable staining process assures uniform part creation without exposing workers to the task of working with chemicals that can be carcinogenic.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "about" or "approximately" means the stated value plus or minus 5%. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

What is claimed is:

1. A method for applying a faux wood grain finish to boards comprising:

1) positioning unfinished boards constructed from cellular polyvinylchloride (PVC) or cement fiber on a conveyor belt;
2) transferring said unfinished boards into a climate-controlled area;
3) denibbing one surface of said unfinished boards to remove surface contaminants and lightly scuffs the surface of the unfinished boards;
4) removing of dust generated by said denibber step by use of an air knife;
5) spraying a faux finish on the surface of the boards, said step of spraying including adjusting of at least one sprayer to achieve a desired depth of color on the surface of the boards;
6) presenting said boards sprayed with a faux finish beneath a wiper, said wiper constructed and arranged to form a faux grain finish;
7) detailing said faux grain finish to include a plurality of faux knots forming a finished board;
8) inserting said finished board from said climate-controlled area into a combination infrared and convection oven having independently controlled curing zones;
9) programming said independently controlled curing zones to provide a specific drying profile for said finished board;
10) cooling said oven cured finished board with forced air cool down fans;
11) transferring said cooled finished board into a climate-controlled area;
12) applying a topcoat to the cooled finished board;
13) transferring said topcoat finished board from said climate-controlled area into a combination infrared and convection oven set to a defined temperature for curing said topcoat;
14) cooling said oven cured topcoat finished board with forced air cool down fans; and
15) packaging said topcoat finished boards for shipping.

2. The method for applying faux wood grain finish according to claim 1 wherein said denibber contains two heads capable of denibbing with about 220 grit abrasives up to 100 fpm.

3. The method for applying faux wood grain finish according to claim 1 wherein said infrared oven contains IR emitters totaling 90 kw/480V/112.5 amps.

4. The method for applying faux wood grain finish according to claim 1 wherein said convection oven operates between 100-180 degrees Fahrenheit using multiple independent zones.

5. The method for applying faux wood grain finish according to claim 1 wherein said step of spraying said finish includes the application of different boards, allowing a color tone to vary based on surface color.

6. The method for applying faux wood grain finish according to claim 1 wherein said step of spraying is performed in a wide canopy moulding finishing machine capable of spraying GrainEx material with a top sprayer and two side sprayers to coat three main profiles of a board at a rate up to 100 fpm.

7. The method for applying faux wood grain finish according to claim 1 wherein said finish is water-based stain.

8. The method for applying faux wood grain finish according to claim 1 wherein said topcoat is clear.

9. The method for applying faux wood grain finish according to claim 1 including a step of tinting said topcoat.

* * * * *